US005287602A

United States Patent [19]

Dykstra

[11] Patent Number: 5,287,602

[45] Date of Patent: Feb. 22, 1994

[54] POWERED TOGGLE LATCH CLAMP

[75] Inventor: Henry Dykstra, Milford, Mich.

[73] Assignee: Delaware Capital Formation, Inc., Wilmington, Del.

[21] Appl. No.: 975,837

[22] Filed: Nov. 13, 1992

[51] Int. Cl.[5] ..... E05C 3/00

[52] U.S. Cl. ..... 24/463; 24/494; 292/247; 292/DIG. 49

[58] Field of Search ..... 24/463, 494, 68 CD; 294/82.3; 292/247, DIG. 49; 414/703; 410/100

[56] References Cited

U.S. PATENT DOCUMENTS

| | | | |
|---|---|---|---|
| 1,062,229 | 5/1913 | Dorney | 292/247 |
| 2,908,114 | 10/1959 | Fouse | 24/463 |
| 3,055,513 | 9/1962 | Kralowetz | 24/463 |
| 3,545,050 | 12/1970 | Blatt et al. | 24/463 |
| 4,056,276 | 11/1977 | Jarvis | 292/DIG. 49 |
| 4,142,751 | 3/1979 | Varda | 292/DIG. 49 |
| 5,061,150 | 10/1991 | Rentschler | 414/703 |

*Primary Examiner*—Victor N. Sakran
*Attorney, Agent, or Firm*—Lloyd M. Forster

[57] ABSTRACT

U-bolt toggle latch clamp actuated by power cylinder having piston rod extending at right angles to toggle linkage reaching aligned relation upon U-bolt retraction to clamping position. The toggle linkage is pivotally connected at one end to a fixed reaction pin, at the other end to a U-bolt crosspin and at the center to the actuating piston rod.

10 Claims, 2 Drawing Sheets

POWERED TOGGLE LATCH CLAMP

BACKGROUND OF THE INVENTION

It is known in the art to provide a manually actuated toggle latch clamp wherein a U-bolt is drawn into latching engagement by pivotal alignment of toggle linkage through handle actuation. Models 323, 324, 331, 334, 341 and 344 over-center toggle locking pull action U-bolt clamps available from De-Sta-Co Division, Dover Resources Inc, are typical of prior art pull action latch clamps.

BRIEF DESCRIPTION OF THE PRESENT INVENTION

A pair of base mounted side brackets are provided with a fixed reaction crosspin pivot for latch actuating toggle linkage. A pair of slots in the side brackets provide a guide for a crosspin to which the ends of a latch U-bolt are adjustably connected, a pair of links pivotally connected to the reaction crosspin and a second pair of links pivotally connected to the U-bolt crosspin are in turn pivotally connected to each other with a pin engaged by the piston rod end of a power cylinder pivotally mounted between the side brackets and extending at a right angle to the toggle linkage when in aligned position corresponding to the extremity position of the U-bolt pin in the side bracket guide slots when in the clamping position of the latch.

Retraction on the piston rod opens the toggle linkage from alignment to an angular relation drawing the U-bolt pin in the guide slots to push the U-bolt to an open position. A laterally projecting pin on one side rod of the U-bolt engages a supplemental side guide slot which deflects the U-bolt to a disengaging position upon opening the clamp and in turn guides the U-bolt to a clamping position upon extending the piston rod to move the toggle linkage to its aligned clamping position.

DETAILED DESCRIPTION OF PREFERRED EMBODIMENT

Figure 2:
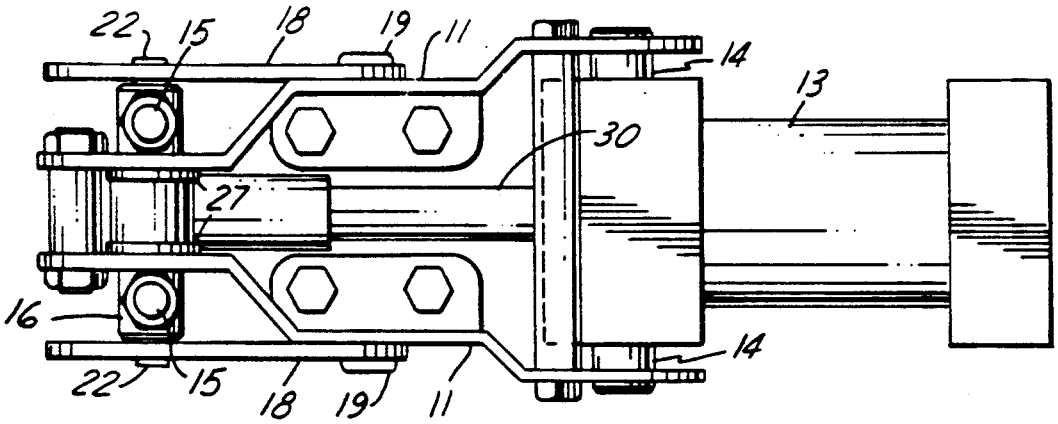
FIG. 2 is a plan view of the clamp assembly shown in FIG. 1.
Figure 1:
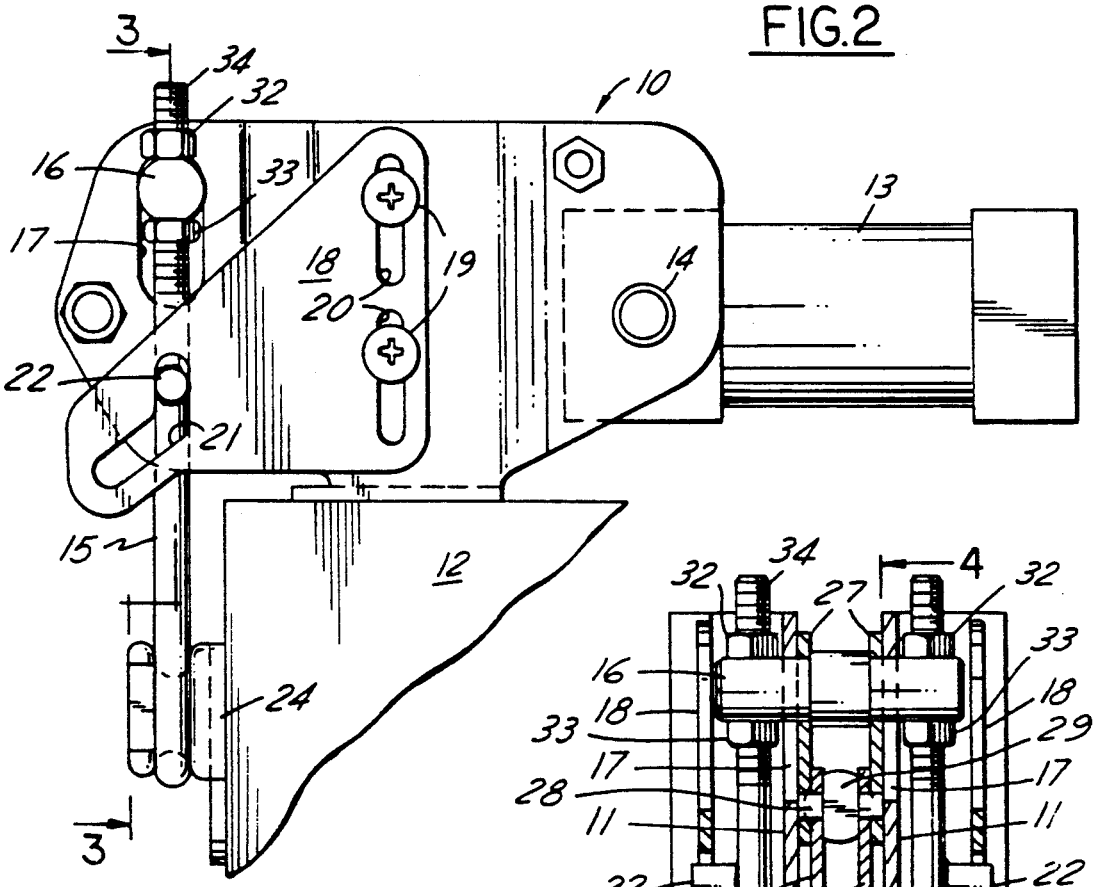
FIG. 1 is a schematic side elevation of clamp assembly mounted on a base, omitting actuating linkage, illustrating the clamp in closed position relative to a latch engaged element.

With reference to FIG. 1, latch clamp assembly 10 includes a pair or side brackets 11, mounted on base 12, between which fluid pressure power cylinder 13 is pivotally mounted at 14. A latch U-bolt 15 is adjustably connected to crosspin 16 extended through guide slots 17 provided in side brackets 11. A supplemental guide 8 is adjustably secured to each of side plates 11, by a pair of screws 9 extending through slots 20, which includes an angular slot 21 for U-bolt guide pin 22 to divert U-bolt 15 to a clamp open position shown at 23 and to return U-bolt 15 to an engaging alignment with clamp element 24 in the clamp closed position.

Figure 3:
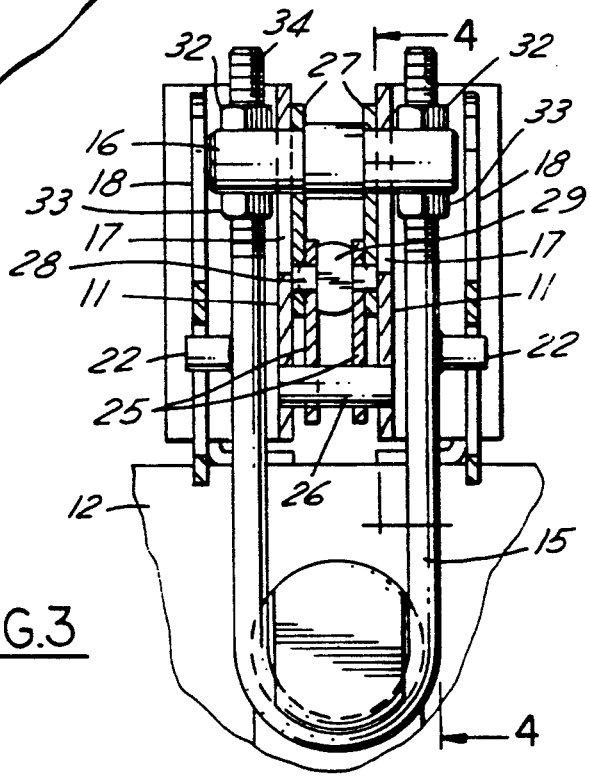
FIG. 3 is an end view of the clamp assembly shown in FIG. 1, including toggle activating linkage, taken along the line 3—3.
Figure 4:
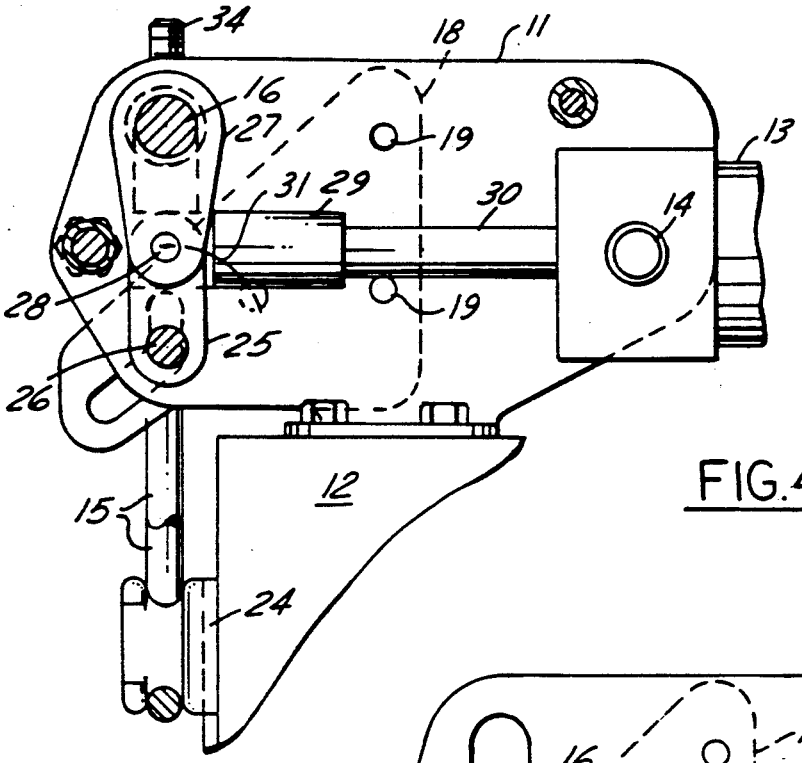
FIG. 4 is a sectional view taken along the line 4—4 of FIG. 3.
Figure 5:
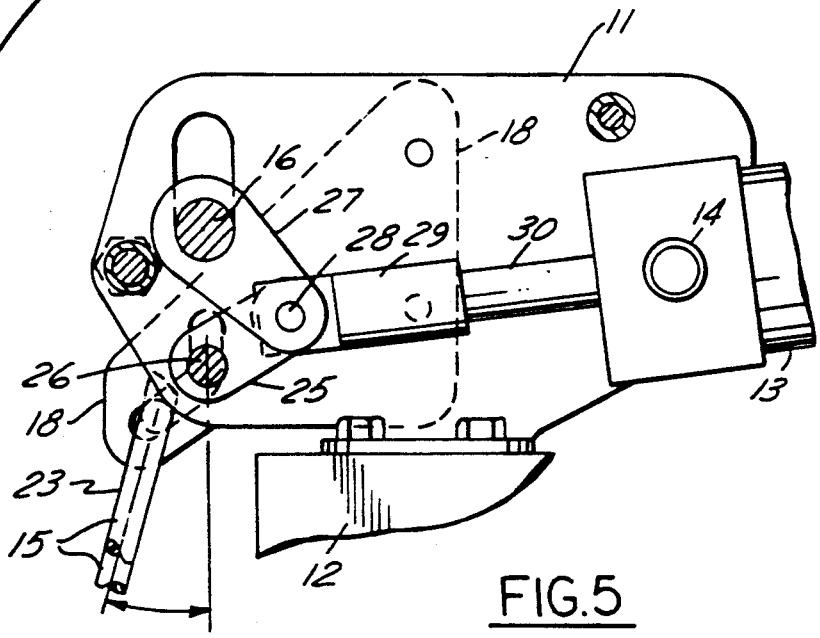
FIG. 5 is a view similar to FIG. 4 showing open position of one of the side brackets per se.

With references to FIGS. 3–5, toggle linkage for actuating U-bolt pin 16 includes a pair of links 25 pivotally connected to fixed crosspin 26 seated in respective side brackets 11. A second pair of links 27 are pivotally connected to crosspin 16, said two pairs of links being pivotally connected to each other by pin 28 passing through piston rod end 29 extending from said piston rod 30 and cylinder 13, piston rod 29 being illustrated in restricted position in FIG. 5. Pivotal mounting 14 of cylinder 13 accommodates the movement of connecting pin 28 and rod end 29 along arcuate path 3 upon retraction of piston rod 30 corresponding to the open position 23 of U-bolt 15.

From the foregoing description it will be understood that the advance of piston from 30 to the aligned position of links 25 and 27 will produce a toggle clamping action corresponding to the clamp closed position illustrated in FIG. 1, and that retraction of the piston rod will produce an opening of the clamp to the position illustrated in FIG. 5. Adjustment of the closed position of U-bolt 15 may be accomplished by adjustment of nuts 34 and 33 on threaded ends 34, and adjustment of the clearance position of U-bolt 15 shown at 23 in FIG. 1 may be effected by adjusting guide 18 as accommodated by screws 19 and slots 20.

I claim:

1. Power toggle latch clamp comprising a pair of sheet metal stamping side brackets, clamp frame means for separate mounting on base, toggle U-bolt latch actuating linkage pivotally mounted on said frame, pressure power cylinder means mounted on said frame, powered means mounted on said frame for reversibly actuating said linkage between release and clamping position, and U-bolt means pulled by said linkage into clamping position, including guide slots in said side brackets and a latch U-bolt pin extending through said slots.

2. Latch clamp of claim 1 including a fixed reaction pin extending between said side brackets.

3. Latch clamp of claim 2 wherein said toggle linkage is pivotally connected to said reaction pin and U-bolt pin.

4. Latch clamp of claim 3 wherein toggle links are pivotally connected to each other, and a piston rod is pivotally connected to the toggle link connection.

5. Latch clamp of claim 4 wherein said power cylinder means comprises a fluid pressure actuated power cylinder with said piston rod for actuating said toggle linkage.

6. Latch clamp of claim 5 wherein the axis of said cylinder and piston rod extends at a right angle to said toggle linkage when aligned in clamping position.

7. Latch clamp of claim 6 including supplemental guide means for deflecting said U-bolt to a clearance position upon release of said latch clamp from clamping position.

8. Power actuation toggle latch clamp for mounting on fixed clamp base comprising pair of base mounted side brackets, fluid pressure actuated power cylinder mounted between said brackets, piston rod actuated by said power cylinder, toggle linkage actuated by said piston rod, latch clamping U-bolt actuated by said toggle linkage, said toggle linkage comprising a fixed reaction pivot pin anchored on said side brackets, guide slots in said brackets for engagement by a latch pin, a latch pin extending through said guide slots, a pair of actuating links pivotally connected to said latch pin, a pair of actuating links pivotally connected to said fixed reaction pivot pin, said piston rod being pivotally connected to both pair of said actuating links with a common pivotal axis, and latch U-bolt means connected to the ends of said pin extending through said guide slots.

9. Latch clamp of claim 8 wherein said links extend in substantial alignment when said latch clamp has reached its clamping position.

10. Latch clamp of claim 9 wherein the axis of said power cylinder and piston rod extends at right angles to said links when in said substantial alignment.

* * * * *

UNITED STATES PATENT AND TRADEMARK OFFICE

CERTIFICATE OF CORRECTION

PATENT NO. : 5,287,602

DATED : February 22, 1994

INVENTOR(S) : Henry Dykstra

It is certified that error appears in the above-identified patent and that said Letters Patent is hereby corrected as shown below:

Column 1, line 31, "on" should be --of--.

Column 1, line 60, "or" should be --of--.

Column 1, line 64 "8" should be --18--.

Column 1, line 66, "9" should be --19--.

Column 2, line 11, "restricted" should be --retracted--.

Column 2, line 13, "3" should be --31--.

Column 2, line 17, "from" should be --rod--.

Column 2, line 24, "34" should be --32--.

Column 2, line 58, claim 8, "actuation" should be --actuated--.

Signed and Sealed this

Ninth Day of August, 1994

Bruce Lehman

*Attest:*

BRUCE LEHMAN

*Attesting Officer*

*Commissioner of Patents and Trademarks*